United States Patent [19]

Wolfsgruber et al.

[11] Patent Number: 4,970,051

[45] Date of Patent: Nov. 13, 1990

[54] PROCESS FOR THE INTRODUCTION OF NITROGEN INTO CAST IRON

[75] Inventors: Friedrich Wolfsgruber, Tacherting; Hartmut Meyer-Grünow, Garching; Detlef Missol, Engelsberg-Offenham; Jochem Richter, Namborn; Julius Veit, Scheidt, all of Fed. Rep. of Germany

[73] Assignees: SKW Trostberg Aktiengesellschaft, Trostberg; Halbergerhuette GmbH, Saarbruecken, both of Fed. Rep. of Germany

[21] Appl. No.: 251,561

[22] Filed: Sep. 30, 1988

[30] Foreign Application Priority Data

Oct. 15, 1987 [DE] Fed. Rep. of Germany ..... 3734877

[51] Int. Cl.[5] ..... C22C 33/08

[52] U.S. Cl. ..... 420/29; 75/526; 75/533; 75/539

[58] Field of Search ..... 75/0.5 R, 53; 420/29, 420/128, 129

[56] References Cited

U.S. PATENT DOCUMENTS

| | | | |
|---|---|---|---|
| 3,322,530 | 5/1967 | Nakamura | 75/51.7 |
| 3,977,868 | 8/1976 | Nakae et al. | 420/15 |
| 4,560,409 | 12/1985 | Goldberger et al. | 420/23 |
| 4,832,739 | 5/1989 | Meichsner et al. | 75/58 |

FOREIGN PATENT DOCUMENTS

| | | |
|---|---|---|
| 840404 | 2/1976 | Belgium . |
| 791836 | 3/9173 | Belgium . |
| 0015662 | 9/1980 | European Pat. Off. . |
| 13992 | 8/1954 | Fed. Rep. of Germany . |
| 1225215 | 9/1966 | Fed. Rep. of Germany . |
| 1608409 | 12/1970 | Fed. Rep. of Germany . |
| 2402945 | 8/1974 | Fed. Rep. of Germany . |
| 2807930 | 9/1979 | Fed. Rep. of Germany . |
| 1229122 | 11/1980 | Fed. Rep. of Germany . |

OTHER PUBLICATIONS

Matsui et al., Nitrogen Content and Defects of Grey Cast Iron Castings, CA(106)(24): 199867y, 1986.

*Primary Examiner*—Deborah Yee
*Attorney, Agent, or Firm*—Felfe & Lynch

[57] ABSTRACT

The present invention provides an agent for the introduction of nitrogen into cast iron, wherein it contains or consists of at least 50% by weight of at least one nitrogen-containing compound with an N—C—N structure and/or a mixture of calcium cyanamide with nitrides of silicon, ferrosilicon, manganese and chromium.

The present invention also provides a process for the introduction of nitrogen into cast iron using this agent.

8 Claims, No Drawings

PROCESS FOR THE INTRODUCTION OF NITROGEN INTO CAST IRON

FIELD OF THE INVENTION

The present invention is concerned with an agent for introducing nitrogen into cast iron containing lamellar graphite or spheroidal graphite and with a process for the introduction of the agent into molten cast iron.

BACKGROUND OF THE INVENTION AND THE PRIOR ART

The work material types of cast iron containing lamellar graphite are standardized. They are referred to the tensile strength of a sample rod with a raw cast diameter of 30 mm. The tensile strength is influenced by the graphite formation, the amount of graphite and the matrix, which can have a pearlitic/ferritic to pearlitic structure. The structure of the matrix can be objectively influenced by the addition of alloying elements. The pearlite structure is stabilized by the elements manganese, chromium, copper and tin with increasing effectiveness. The addition of these elements to the cast iron represents a noteworthy cost factor (for example of copper or tin) and, in the case of chromium and manganese, can only take place up to certain upper limits. In particular, alloying elements such as manganese and chromium increase the danger of ledeburitic hardening so that they can only be used up to a maximum of 1 or 0.5% by weight, respectively, without having a negative action on the workability of the cast iron. In the case of the use of chromium, it is to be observed that the chromium content, even in the case of repeated remelting, is not broken down. This also applies to copper. This state of affairs also places limits on the alloying of copper although a pearlite stabilization without the additional danger of ledeburitic hardening becomes possible. Furthermore, only relatively expensive, very pure copper can be used in order to exclude a damaging action of trace elements which can be present in the copper. Thus, the production of cast iron workpiece with the use of chromium- and copper-alloyed circulation material involves considerable disadvantages.

A very effective pearlite stabilization is achieved with tin but the costs are significant. With this element, there is achieved a completely pearlitic structure in all regions of the cast piece. However, a further addition of tin to cast iron which already has a completely pearlitic structure does not further increase its tensile strength.

Besides the above-mentioned elements, it is also known to introduce nitrogen into cast iron as alloying element in order to improve the strength and workability of the work material. Thus, in Federal Republic of Germany Patent Specification No. 16 08 409, there is disclosed the introduction of nitrogen into a cast iron alloy with a conventional base composition in order to avoid a structural change from pearlite to ferrite at high working temperatures. The introduction of the nitrogen thereby takes place by the addition of a nitrogen compound which is pressed into tablets with an inoculant. In this way, 0.009 to 0.018% of nitrogen is admittedly alloyed into the cast iron but, in addition, the components of the inoculant are also introduced. No statements are made regarding the manner and in what amounts the nitrogen compounds with inoculants are added to the cast iron so that a use of the process is made difficult or a dependable adjustment of the nitrogen content in the cast iron is not ensured.

Federal Republic of Germany Patent Specification No. 24 02 945 describes a high-strength cast iron containing spheroidal graphite and a process for the production thereof. The introduction of nitrogen to give contents of 0.0035 to 0.02% by weight of nitrogen takes place by means of nitrogen-containing alloys, such as Fe-Mn-N and Fe-Cr-N, or with hexamine.

In the case of the use of nitrogen-containing alloys, the nitrogen availability and thus the nitrogen yield is relatively widely distributed. The nitrogen yield is very low so that the alloys have to be used in relatively large amounts which, in turn, results in undesirable effects, such as the introduction of a relatively large amount of foreign metal, increased production of slag and insufficient solubility behavior of the nitrogen. Since hexamine is a high explosive (see P. Karrer, Lehrbuch der Organischen Chemie, 1963, p. 500), the use thereof is dangerous.

The solubility equilibrium for nitrogen in cast iron is influenced by the alloying elements and the temperature of the molten iron. In the temperature range of from 1400° to 1550° C., which is usual therefor, the solubility equilibrium for nitrogen in technical cast iron alloys lies at 40 to 60 ppm. The result of this is that all nitrogen contents which lie above the value of this solubility equilibrium are unstable. The loss of nitrogen is usually 10 ppm per 30 minutes standing time of the melt at 1480° C. A subsequent correction of the nitrogen content by the addition of further nitrogen-containing alloys is no longer possible because of the increase of the manganese or chromium values involved therewith which would give rise to an undesired ledeburitic hardening of the cast iron.

OBJECTS OF THE INVENTION

Therefore, it is an object of the present invention to provide an agent and a process which permits a simple, economic pearlite stabilization or strength increase working with high nitrogen yield by increasing the pearlite content in cast iron contaning lamellar graphite or spheroidal graphite.

DESCRIPTION OF THE INVENTION

Thus, according to the present invention, there is provided an agent for introducing nitrogen into cast iron, which contains or consists of at least 50% by weight of at least one nitrogen-containing compound with an N-C-N structure and/or a mixture of calcium cyanamide with nitrides of silicon, ferrosilicon, manganese and chromium.

Thus, we have found that such compounds give a high nitrogen yield without introducing undesirable alloying metals. As nitrogen compounds, those are advantageously used with a high nitrogen content which are economically available on a large scale. These include, in particular, cyanamide, dicyandiamide, guanidine, aminoguanidine, urea, hexamethylenetetramine, cyanuric acid, azulmic acid, melamine, melam, melem, melon, polymeric triazine compounds and guanamines, which are preferred.

These nitrogen compounds preferably present in the agents according to the present invention have the property of decomposing in the molten cast iron to give gaseous products so that slag formation is avoided. Furthermore, it is possible therewith to make up nitrogen losses at any time by repeated addition of the agent without thereby having to fear undesirable changes of the properties by an excessive introduction of other alloying elements, for example manganese and chromium.

However, besides the above-mentioned preferred compounds with an N-C-N structure, there can also be used those with a high nitrogen content (about 15 to 40% by weight) which form a calcium- or silicon-containing slag. According to this embodiment of the present invention, use is made of calcium cyanamide, for example in its technical form, and mixtures thereof with nitrides of silicon, ferrosilicon, manganese and chromium.

Furthermore, it has proved to be advantageous when the agent according to the present invention also contains additive materials which bring about an acceleration or retarding of the reaction in the molten cast iron in an amount of from 0.5 to 50% by weight and which consist essentially of carbon, iron and/or silicon. Appropriate additive materials include steam coal, ferrosilicon, iron, graphite, highly dispersed silicic acid and silicon dioxide-containing dust by means of which, dependng upon the nitrogen compound used and the nitrogen requirement, the nitrogen yield can be optimised. The agent preferably contains 10 to 35% by weight of one of the mentioned additive materials.

A substantially homogeneous distribution in the cast iron melt is achieved when the agent is present in powder form with a grain size of 0.01 to 5 mm. and preferably of from 0.5 to 2 mm. However, a granulate with a grain size of from 0.01 to 5 mm. and preferably of from 0.5 to 2 mm. also reacts in an advantageous way in the molten cast iron. In order to achieve an optimum nitrogen yield and a homogeneous distribution in the molten cast iron, the agent according to the present invention is packed into a filled wire and shot into the melt. It has also proved to be useful to blow in the agent in the form of a powder or granulate by means of an immersion lance with the help of a gas stream. As carrier gas, there can thereby be used, for example, air, nitrogen or argon.

The possibility also exists of using ammonia as carrier gas for blowing in the agent according to the present invention but this method has the disadvantage of a not so exactly measurable provision of nitrogen since ammonia decomposes at the temperatures of the molten cast iron and thus itself acts as nitrogen donor. However, this method is advantageously used when a cast iron with high values for nitrogen are to be produced.

It has proved to be useful, depending upon the temperature and the composition of the iron, to use different nitrogen carriers and additive materials. Particular attention is to be given to the temperature of the molten iron. By means of an appropriate composition of the agent, the introduction of nitrogen according to the present invention can be carried out in the temperature range of from 1200° to 1600° C.

The composition of the agent in the case of different temperatures is explained in more detail in the following Examples. For the extremely low temperature range of from 1260° to 1280° C., it is preferred, for example, to use a mixture of about 97% by weight of urea and about 3% by weight of steam coal (Example 2). In the middle temperature range of from 1310° to 1340° C., it is preferred to use urea for the introduction of nitrogen (Example 1) and at a temperature of 1460° C. there is added to the molten iron for example a mixture of 35% by weight or urea, 35% by weight of dicyandiamide and 30% by weight of ferrosilicon.

As a result of its high nitrogen content and of an excellent nitrogen yield, the amount of the agent required is small. Depending upon the nature of the agent, the manner of its introduction and the desired strength increase, per ton of cast iron there are used from 0.1 to 6 kg. of the agent. There is preferably used an amount of from 0.5 to 1 kg. of the agent in order to adjust, in the cast iron with lamellar graphite or spheroidal graphite, a nitrogen content of from 50 to 200 ppm.

The following Examples are given for the purpose of illustrating the present invention:

EXAMPLE 1

In a grid frequency induction crucible furnace there are present 13 tons of cast iron in the temperature range of from 1310° to 1340° C., the cast iron having the following chemical composition:

| | |
|---|---|
| C = 3.43% | S = 0.09% |
| Si = 1.82% | Al = 0.003% |
| Mn = 0.68% | Ti = 0.02% |
| Cr = 0.19% | N = 42 ppm |
| Cu = 0.05% | Fe = remainder |

The tensile strength (Rm) of this quality, measured on a cast sample rod of 30 mm. diameter, is to be increased by the introduction of nitrogen into the molten cast iron by 50 N/mm$^2$ ($\Delta$Rm). An increase of the amount of nitrogen by 10 ppm of free nitrogen improves the tensile strenght by 7 N/mm$^2$. The nitrogen content of the untreated cast iron is 42 ppm.

In aluminum and titanium, according to the following calculation, there is bound the following nitrogen concentration as nitride:

$$\% \text{ N as aluminum nitride} = \frac{\% \text{ Al}}{1.93} =$$

0.0015 corresponding to 15 ppm.

$$\% \text{ N as titanium nitride} = \frac{\% \text{ Ti}}{3.43} =$$

0.0059 corresponding to 59 ppm.

The necessary nitrogen concentration for an increase of the tensile strength by 50 N/mm$^2$ is calculated according to:

$$\frac{\Delta Rm}{7} \times 10 + \text{ppm}_{nitride\ nitrogen} = \text{ppm}_{total\ nitrogen}$$

$$\frac{50}{7} \times 10 + 15 + 59 = 146$$

Necessary increase of the nitrogen content
$= 146 \text{ ppm} - 42 \text{ ppm} = 104 \text{ ppm}$ For the introducton of nitrogen into the molten cas iron, there is used a filled wire of 13 mm. diameter which contains 120 g./m. powdered urea, corresponding to a nitrogen content of 55 g./m.

4 tons of molten iron are removed from the furnace. The temperature of the remaining content is maintained without bath movement and 80 m. of the filled wire are introduced at a running rate of 50 m./minute. The furnace is subsequently made up to a content of 13 tons.

The nitrogen concentration of 152 ppm in the cast iron measured thereafter corresponds to a nitrogen yield of 32.5%.

By means of this increase of the nitrogen content achieved with the agent according to the present invention, there is achieved an increase of the tensile strength, measured on a 30 mm. diameter sample rod, of from 260 to 315 N/mm$^2$.

EXAMPLE 2

In a grid frequency induction crucible furnace are present 13 tons of cast iron in the temperature range of from 1260° to 1280° C., the cast iron having the following composition:

| | |
|---|---|
| C = 3.38% | S = 0.08% |
| Si = 1.83% | Al = 0.004% |
| Mn = 0.06% | Ti = 0.02% |
| Cr = 0.17% | N = 48 ppm |
| Cu = 0.04% | Fe = remainder |

As in Example 1, the tensile strength is to be increased by 50 N/mm$^2$. The calculation of the nitrogen concentration required for increasing the tensile strength takes place as described in Example 1 and gives a value of 103 ppm.

For the introduction of nitrogen into the molten cast iron, there is used a filled wire of 13 mm. diameter which contains a mixture of 97% by weight of urea and 3% by weight of steam coal. Its filling weight is 120 g./m. and the nitrogen content is 54 g./m.

78 m. of this filled wire are introduced into 9 tons of molten cast iron at a rolling in rate of 40 m./minute and a further 4 tons of cast iron are added thereto. The measured nitrogen concentration of 148 ppm in the cast iron corresponds to a nitrogen yield of 30.8%.

By means of this increase of the amount of nitrogen, there is achieved an increase of the tensile strength, measured on a 30 mm. diameter sample rod, of from 240 to 288 N/mm$^2$.

EXAMPLE 3

In a transport ladle with a capacity of 3 tons, cast iron of the following composition is kept ready for the introduction of nitrogen at 1460° C.:

| | |
|---|---|
| C = 3.38% | S = 0.07% |
| Si = 2.06% | Al = 0.003% |
| Mn = 0.55% | Ti = 0.01% |
| Cr = 0.14% | N = 55 ppm |
| Cu = 0.05% | Fe = remainder |

An increase of the tensile strength, measured on a sample rod of 30 mm. diameter, by 50 N/mm$^2$ is aimed for.

The calculation of the nitrogen concentration required for increasing the tensile strength takes place as described in Example 1 and gives a value of 41 ppm.

For the introduction of nitrogen into the molten cast iron, there is used a filled wire of 9 mm. diameter which contains a mixture of 35% by weight urea, 35% by weight dicyandiamide and 30% by weight FeSi 75. The filling weight of this wire is 34 g./m. and the nitrogen content is 29 g./m.

28 m. of this filled wire are rolled off into the cast iron melt at a speed of 5 m./minute. The measured nitrogen concentration of 119 ppm in the cast iron corresponds to a nitrogen yield of 23.6%. There is achieved an increase of the tensile strength, measured on a sample rod of 30 mm. diameter, of from 210 to 246 N/mm$^2$.

EXAMPLE 4

In a grid frequency induction crucible furnace of 9 tons usable capacity there are present 8.2 tons of cast iron at a temperature of 1320° C., the cast iron having the following composition:

| | |
|---|---|
| C = 3.47% | S = 0.08% |
| Si = 1.85% | Al = 0.003% |
| Mn = 0.60% | Ti = 0.02% |
| Cr = 0.14% | N = 27 ppm |
| Cu = 0.05% | Fe = remainder |

The tensile strength of this cast iron is to be increased by 80 N/mm$^2$. The calculation of the nitrogen concentration necessary for increasing the tensile strength takes place according to Example 1 and is 161 ppm.

For the introduction of nitrogen into the molten cast iron, there is used a filled wire of 13 mm. diameter which contains a mixture of 97.5% by weight hexamethylenetetramine and 2.5% by weight highly dispersed silicic acid. Its filling weight is 108 g./m. and the nitrogen content is 42 g./m.

96 m. of this filled wire are rolled at a rate of 55 m./minute into 8.2 tons of molten cast iron. The measured nitrogen concentration of 207 ppm in the cast iron corresponds to a nitrogen yield of 36.6%.

There is achieved an increase of the tensile strength, measured on a 30 mm. diameter sample rod, of from 244 to 310 N/mm$^2$.

EXAMPLE 5

In a transport ladle, 3 tons of cast iron with the composition given in Example 3 are kept ready for the introduction of nitrogen at a temperature of 1478° C.

An increase of the tensile strength, measured on a sample rod of 30 mm. diameter, by 40 N/mm$^2$ is aimed for.

The calculation of the nitrogen concentration needed for increasing the tensile strength takes place as described in Example 1 and is 61 ppm.

For the introduction of nitrogen into the molten cast iron to give this value, there is used a filled wire of 9 mm. diameter which contains 97% by weight of calcium cyanamide and 3% by weight of steam coal.

The filling weight of this wire is 85 g./m. and the nitrogen content is 19 g./m.

25 m. of this filled wire are rolled off at a speed of 25 m./minute into the molten cast iron standing ready. The nitrogen concentration of 112 ppm measured thereafter corresponds to a nitrogen yield of 15.2%.

The tensile strength, measured on a sample rod of 30 mm. diameter, is increased from 210 to 258 N/mm$^2$.

We claim:

1. The method of introducing nitrogen into the cast iron containing lamellar or spheroidal graphite, which comprises introducing into the molten cast iron a powdered composition comprising at least 50% by weight of at least one nitrogen-containing compound with an N-C-N structure selected from the group consisting of urea, dicyandiamide, guanidine, hexamethylenetetramine, cyanamide, aminoguanidine, and optionally calcium cyanamide and/or a mixture of calcium cyanamide with a nitride of silicon, ferro-silicon, manganese or chromium, in the form of a filled wire.

2. The method of introducting nitrogen into cast iron containing lamellar or spheroidal graphite, which comprises introducing into the molten cast iron a powdered composition comprising at least 50% by weight of at least one nitrogen-containing compound with an N-C-N structure selected from the group consisting of urea, dicyandiamide, guanidine, hexamethylenetetramine, cyanamide, aminoguanidine, and optionally calcium cyanamide and/or a mixture of calcium cyanamide with a nitride of silicon, ferro-silicon, manganese or chromium, by blowing said composition into the molten cast iron with the aid of an inert gas stream through an immersion lance.

3. The method of claim 1, wherein 0.1 to 6 kg. of said composition are introduced per ton of molten cast iron.

4. The method of claim 2, wherein 0.1 to 6 kg. of said composition are introduced per ton of molten cast iron.

5. The method of claim 1, wherein 0.5 to 1.0 kg. of said composition is introduced per ton of molten cast iron.

6. The method of claim 2, wherein 0.5 to 1.0 kg. of said composition is introduced per ton of molten cast iron.

7. The method of claim 1, wherein the cast iron product produced by the method has a nitrogen content of 50 to 200 ppm.

8. The method of claim 2, wherein the cast iron product produced by the method has a nitrogen content of 50 to 200 ppm.

* * * * *